US011391005B2

(12) United States Patent
Journeaux et al.

(10) Patent No.: US 11,391,005 B2
(45) Date of Patent: Jul. 19, 2022

(54) SYSTEM AND METHOD FOR MITIGATING ROCKFALLS

(71) Applicant: R&B Leasing, LLC, Grand Junction, CO (US)

(72) Inventors: Daniel Lorne Journeaux, Ontario (CA); Marcel Fulde, Thalwil (CH)

(73) Assignee: R&B Leasing, LLC, Grand Junction, CO (US)

( * ) Notice: Subject to any disclaimer, the term of this patent is extended or adjusted under 35 U.S.C. 154(b) by 158 days.

(21) Appl. No.: 16/989,624

(22) Filed: Aug. 10, 2020

(65) Prior Publication Data

US 2020/0370252 A1 Nov. 26, 2020

Related U.S. Application Data

(63) Continuation-in-part of application No. 15/669,617, filed on Aug. 4, 2017, now Pat. No. 10,738,424.

(51) Int. Cl.
*E01F 7/04* (2006.01)

(52) U.S. Cl.
CPC ..... *E01F 7/045* (2013.01)

(58) Field of Classification Search
CPC ... E01F 7/045; E01F 7/00; E01F 7/025; E01F 7/04
See application file for complete search history.

(56) References Cited

U.S. PATENT DOCUMENTS 3,274,783 A 9/1966 Handy
5,186,438 A 2/1993 Cross et al.
(Continued)

FOREIGN PATENT DOCUMENTS

AT 246765 B * 5/1966
CN 110438915 A * 11/2019
(Continued)

OTHER PUBLICATIONS

Castanon-Jano, L., et al., "Energy dissipating devices in falling rock protection barriers", Researchgate, Nov. 2016, 34 pages.
(Continued)

*Primary Examiner* — Jonathan P Masinick
(74) *Attorney, Agent, or Firm* — Berg Hill Greenleaf Ruscitti LLP

(57) ABSTRACT

A system of the invention includes at least one barrier layer, a plurality of rockfall attenuators and two primary anchor points to anchor opposite lateral sides of the barrier layer. The attenuators are secured to an upper portion of the barrier layer. The attenuators create a gap between the surfaces of the slope upon which the barrier layer is installed. The attenuators are attached to the barrier mesh by a cable routed through a clevis/eyelet on each of the attenuators. Opposite ends of the cable are secured to the sloping surface by the two primary anchor points. The attenuators are free floating members that are not attached to the sloping surface. The invention also comprises attenuators as a sub-combination and a method of installing the system. One embodiment of an attenuator includes interconnected structural members resembling a closed-shaped frame. Another embodiment includes a covering placed over the structural members.

27 Claims, 13 Drawing Sheets

(56) References Cited

U.S. PATENT DOCUMENTS

| | | | |
|---|---|---|---|
| 5,299,781 | A | 4/1994 | Barrett et al. |
| 5,961,099 | A | 10/1999 | Thommen, Jr. |
| 5,996,972 | A | 12/1999 | Kaiser |
| 6,131,873 | A | 10/2000 | Blazon et al. |
| 6,247,873 | B1 | 6/2001 | Fukui |
| 6,279,858 | B1 | 8/2001 | Eicher |
| 7,384,217 | B1 | 6/2008 | Barrett et al. |
| 7,455,480 | B2 | 11/2008 | Melegari |
| 7,458,449 | B2 | 12/2008 | Sennhauser |
| 7,708,502 | B2 | 5/2010 | Carte et al. |
| 8,079,571 | B2 | 12/2011 | Nishita et al. |
| 8,955,655 | B2 | 2/2015 | Von Allmen et al. |
| 9,031,791 | B2 | 5/2015 | Nedilko et al. |
| 9,309,636 | B2 | 4/2016 | Wyllie |
| 2004/0041139 | A1 | 3/2004 | Rambaud |
| 2018/0274618 | A1 | 9/2018 | Ng et al. |
| 2019/0040594 | A1 | 2/2019 | Journeaux |
| 2020/0370252 | A1 | 11/2020 | Journeaux et al. |

FOREIGN PATENT DOCUMENTS

| | | | | |
|---|---|---|---|---|
| EP | 1130166 | A2 | 9/2001 | |
| EP | 0877122 | B1 | 4/2003 | |
| FR | 2669047 | A1 | 5/1992 | |
| FR | 2695177 | A1 * | 3/1994 | ..... E01F 7/045 |
| FR | 3054576 | A1 | 2/2018 | |
| GB | 2278862 | A * | 12/1994 | ..... B09B 1/004 |
| WO | 2018215216 | A1 | 11/2018 | |

OTHER PUBLICATIONS

International Search Report and Written Opinion in International Application PCT/US21/38428 dated Sep. 29, 2021, 9 pages.

* cited by examiner

SYSTEM AND METHOD FOR MITIGATING ROCKFALLS

CROSS REFERENCE TO RELATED APPLICATIONS

This application is a continuation-in-part application of U.S. Ser. No. 15/669,617, filed on Aug. 4, 2017 entitled "SYSTEM AND METHOD FOR MITIGATING ROCKFALLS", this prior application being incorporated herein by reference in its entirety.

FIELD OF THE INVENTION

The invention relates to barriers for protecting personnel and equipment from falling rocks and earth, such as caused by rockfalls and landslides that may occur on a sloping surface, and more particularly, to a system and method of mitigating damage from rockfalls and landslides including at least one barrier layer and a plurality of rockfall attenuators mounted to the sloping surface.

BACKGROUND OF THE INVENTION

Rockfalls are generally defined as groups of loose rocks or rock formations that become dislodged from a rock face under the influence of gravity. Rockfalls present a significant hazard for personnel and equipment that may be present in the pathway of the rockfall. An active rockfall area can be extremely hazardous; a falling rock contains a tremendous amount of energy, and even relatively small rocks can cause significant damage to equipment and structures and can cause loss of life.

There are a number of mitigation techniques available to reduce the potential damage from rockfall. During construction practices, it is often necessary to provide temporary protection from rockfalls. One type of commonly used temporary barrier includes the use of a flexible barrier such as metal fencing or mesh that is secured by anchors to the slope at designated locations that is subject to rockfall events. If a rockfall occurs, the rock and associated debris are routed under the flexible barrier and between the mesh and the rockfall face. This channeling effect controls the fall of rocks and debris to prevent the rocks from free falling and causing potentially devastating damage to equipment and potential loss of life An additional measure for mitigation is to excavate a catch basin at the base of the slope so any falling rocks are caught within the basin and therefore cannot fall below the location of the basin.

There are a number of US and foreign patent references that disclose barrier systems to mitigate damage from rockfalls. Some of these references provide complex flexible barrier configurations while others employ a large number of anchors or posts for supporting one or more flexible barrier members. One common theme however in most if not all of these references is that they are complex and require significant resources and manpower to install.

While there may be a number of solutions available for limiting the hazards associated with rockfalls and landslides, there are some inherent drawbacks with many of these solutions. For rockfall barriers that incorporate anchors such as metal posts to secure the metal barrier fencing, it can be very difficult to install the requisite number of posts on difficult to access sloping surfaces where rockfalls are actively occurring. Furthermore, the posts are commonly designed to break away or bend if the posts receive a direct hit from a falling rock or if the mesh experiences an excessive impact from falling rocks and debris. As a result of a direct hit or the force of many rocks striking the barrier fencing adjacent a post, the post must be replaced in many circumstances which require additional resources and manpower to repair or reset the system. For larger more catastrophic rockfalls, a number of adjacent posts may be destroyed which can further compromise the overall integrity of the barrier system and may allow the escape of falling rocks and debris.

Therefore, there is a need to provide a rockfall barrier system that is capable of withstanding direct hits from rocks and falling debris without having to individually replace each post or anchor system that is used to hold the fencing. There is also a need to provide a rockfall barrier system that is easy to install, repair, and to minimize the length of exposure time of personnel to rockfall hazards. There is also a need to provide a rockfall barrier system that can effectively achieve dissipation of the energy associated with a rockfall in a cost-effective manner yet ensuring the safety of personnel and equipment that may be located in the rockslide area.

SUMMARY OF THE INVENTION

The invention includes a system and method for mitigating rockfalls and landslides. As used herein, the term "rockfalls" is not limited to mitigation of only falling rocks, but also associated debris such as earth and other miscellaneous debris that may be carried downward by the force of rocks and water associated processes such as debris flows that may strike a sloping surface. In order to simplify the description of the invention herein, the term "rockfall" also includes events that may be more accurately characterized as landslides or debris flows in which a greater percentage of earth may move down slope as compared to rocks. Therefore, it should be understood that the system and method of the invention is equally applicable for mitigating rockfalls, landslides, or any other characterizations of objects that may fall down a sloping surface as a result of gravity.

In a preferred embodiment of a system of the invention, it includes a primary barrier layer covering a rockfall area, one or more secondary barrier layers, and a plurality of rockfall attenuators or bumpers selectively disposed along the primary barrier layer to provide structure for holding the barrier layers against the rockfall area. A rockfall area typically includes a sloping surface over which rock and debris may fall. The primary barrier layer may be made of a selected mesh material. The one or more secondary barrier layers may be made of finer and lighter mesh material as compared to the primary barrier layer. The attenuators are "free floating" members in that they are not attached to the sloping surface.

According to one feature of the invention, the rockfall attenuators or bumpers are provided to not only hold the barrier layer(s) against a sloping surface and to provide the necessary gaps between the sloping surface and the barrier layers to trap incoming rocks from the rockfall event, but the rockfall attenuators are also employed to provide substantial energy absorption for rocks that may strike the attenuators.

According to a preferred embodiment of the attenuators or bumpers, they comprise an inflatable member made of a resilient and flexible material such as rubber, a selected thermoplastic, or combinations thereof. During a rockfall event, rocks striking the attenuators or bumpers are slowed due to a "bounce" effect in which energy is absorbed by the compression and subsequent expansion of the attenuators or bumpers. Because the attenuators are not directly attached to the sloping surface, rocks are allowed to flow beneath the individual attenuators and in the gaps between the adjacent attenuators, thereby facilitating the necessary control of rocks and debris as the material moves down slope. Further, because of the resilient nature of the bumpers/attenuators, a direct hit by a rock or other debris will not destroy the bumpers/attenuators and rather, and at least some of the energy from the strike will be directly absorbed by the struck bumper/attenuator.

A shape of the attenuators may be selected to achieve desired functionality associated with use of the attenuators at a specific job site. For example, the attenuators could be spherical shaped or cylindrical shaped in which the curved or rounded exterior surface of the attenuator would be in contact with the sloping surface to accommodate a bounce effect against the slope in response to a direct rock hit or in response to a flow of material beneath the attenuators.

The attenuators may be resilient inflatable members selectively spaced from one another to provide a necessary separation of the barrier layer from the slope. As mentioned, the attenuators also provide supplemental force resistance against a rockfall event in which the attenuators provide a reaction force due to their resilient construction.

Another advantage of using resilient and flexible attenuators is that they are capable of being installed on sloping surfaces having an infinite number of undulations or irregularities. The lower surface of the attenuators will naturally rest against any underlying surface and without the necessity of installing a dedicated post or anchor at that location. Accordingly, the attenuators allow for easy installation of the barrier system on slopes of many different configurations.

Yet another distinct advantage of the attenuators is that they may not only displace vertically away from the slope but may also move laterally and then return approximately to their originally deployed locations. For example, a rockfall event could involve a concentrated number of rocks that may strike or otherwise envelop two or more adjacent attenuators. In this case, the attenuators may be forced to move both laterally and vertically due to the inherent unpredictable nature in which the rocks may strike the barrier. Because of the capability of the attenuators to individually move both vertically and laterally, better energy absorption can be achieved without destruction of the barrier system. After termination of the rockfall event, the attenuators will return to their approximate original deployed locations.

The invention may also include a method of mitigating rockfall events in which a barrier is provided including a plurality of resilient and flexible attenuators. The attenuators are secured to an upper portion of the mesh barrier and are capable of displacing laterally and vertically in response to a rockfall event.

A single support cable can be deployed for securing the attenuators and mesh barrier layer(s) to the sloping surface. The cable may be strung laterally across the upper ends of the barrier layer(s). The attenuators can be selectively disposed in a desired configuration such as in serial fashion, side by side, across the barrier layer(s). At least two anchor points are provided for securing the support cable to the sloping surface, one located at each end of the cable. The anchor points must be robust anchors to support the system and therefore, the anchor points could comprise multiple anchoring elements. The anchor points may be drilled anchors with sufficient pull-out capacity to withstand significant forces that may be experienced in a rockfall event. Although an advantage of the invention is that only a single support cable may be required for some installations, it should be understood that multiple cables strung together between the anchor points may be another solution for purposes of attaching the attenuators and primary and secondary barrier layers. A multiple cable configuration could include cables arranged serially or in parallel to one another.

Specifically considering the above features of the invention, in one aspect, it may be considered a system for mitigating rockfall events on a sloping surface, the system comprising: a primary barrier layer having a width extending laterally across the sloping surface and a length extending down the sloping surface; a secondary barrier layer placed over the primary barrier layer, said secondary barrier layer having a width extending laterally across the sloping surface and a length extending down the sloping surface; a plurality of attenuators spaced laterally from one another and spaced laterally across the width of the primary barrier layer; a supporting cable extending laterally across the sloping surface, wherein upper portions of the primary and secondary barrier layers are attached to said supporting cable, and each of said plurality of attenuators are secured to said supporting cable; a first anchor point for securing a first end of said supporting cable; and a second anchor point for securing a second opposite end of said supporting cable.

According to another aspect of the invention, the attenuators have separate utility and can be used with other mitigation systems in order to separate any type of barrier layer(s) from a sloping surface and to provide secondary energy absorption for moving objects that strike the attenuators. In this regard, the attenuators may be considered a sub-combination of the invention or elements with separate utility. Accordingly, the attenuators in another aspect of the invention may comprise a body defining an outer surface, an interior surface and a sidewall defined as a thickness between the outer surface and interior surface; a chamber defining a hollow area within said body; a flange having a first end secured within the chamber and a second end protruding through a sidewall of the body, said second end including an eye exposed for connection to a desired implement; said body being made of a resilient and flexible material such that if the body is contacted by an external object with sufficient force, said body will compress in reaction thereto and subsequently decompressed after the force is removed.

According to yet another aspect of the invention, it may be considered a method of mitigating rockfall events on a sloping surface, the method comprising: positioning a primary barrier layer having a width extending laterally across the sloping surface and a length extending down the sloping surface; installing a plurality of attenuators that are spaced laterally from one another and spaced laterally across the width of the primary barrier layer; securing a supporting cable to extend laterally across the sloping surface, wherein an upper portion of the primary barrier layer is attached to said supporting cable, and each of said plurality of attenuators are secured to said supporting cable; installing a first anchor point for securing a first end of said supporting cable, and installing a second anchor point for securing a second opposite end of said supporting cable.

According to yet another aspect of the invention, it may be considered another system for mitigating rockfall events on a sloping surface, the system comprising: a barrier layer having a width extending laterally across the sloping surface and a length extending down the sloping surface; a plurality of attenuators spaced laterally from one another and spaced laterally across the width of the barrier layer, each of said attenuators being constructed of a resilient and flexible material, and said attenuators having an inflatable interior chamber for selected inflation or deflation thereof; a supporting cable extending laterally across the sloping surface, wherein upper portions of the primary barrier layers is attached to said supporting cable, and each of said plurality of attenuators are secured to said supporting cable; and first and second anchor points for securing opposite ends of said supporting cable to the sloping surface.

According to yet another aspect of the invention, it may be considered a system for mitigating rockfall events on a sloping surface, the system comprising: a barrier layer having a width extending laterally across the sloping surface and a length extending down the sloping surface; a plurality of attenuators spaced laterally from one another and spaced laterally across the width of the barrier layer, each attenuator having a plurality of support members connected to one another in a geometric pattern, each support member having a first end connected to a first connector and a second end connected to a second connector, and wherein each attenuator has a geometric shape with a plurality of sides formed by the support members connected in the geometric pattern; a supporting cable extending laterally across the sloping surface, wherein an upper portion of the barrier layer is attached to said supporting cable, and each of said plurality of attenuators are secured to said supporting cable; a first anchor point for securing a first end of said supporting cable; and a second anchor point for securing a second opposite end of said supporting cable.

According to this last-mentioned system, optional features thereof may include: said barrier includes a mesh configuration, said attenuators are substantially evenly spaced from one another laterally across the width of the primary barrier layer, said attenuators are each of substantially a same size and shape, said attenuators include at least one attenuator that has a substantially different size and shape as compared to other attenuators, and wherein spacing between each of said plurality of support members is open, and wherein an interior of each attenuator is open.

Yet further according to this last-mentioned system, another optional feature may include an additional barrier installed at a location near the system. The additional barrier, in one preferred embodiment, is constructed similar to the barrier system by inclusion of its own attenuators, barrier mesh layer, support cables and ground anchors.

According to yet another aspect of the invention, it may be considered an energy absorbing attenuator especially adapted for use within a rockfall mitigation system, said attenuator comprising: a plurality of support members connected to one another in a geometric pattern; each support member having a first end connected to a first connector and a second end connected to a second connector; each attenuator having a geometric shape with a plurality of sides formed by the support members connected in the geometric pattern; and wherein space between each of said plurality of support members is open and wherein an interior of each attenuator is open thereby forming a framed attenuator structure.

According to the last-mentioned attenuator, optional features thereof may further include: a clevis attached to one of said connector; said plurality of support members being constructed of at least one of aluminum, iron or steel; said plurality of support members being constructed of carbon fibers or metallic tubing, said carbon fibers/metallic tubing including square tubing; an exterior covering placed over said plurality of support members, the exterior covering being made of a flexible elastomeric material, the exterior covering being continuous over said plurality of support members; the exterior covering being continuous over said plurality of support members and wherein the interior of said attenuator is pressurized; and a valve secured to said exterior covering for controlling pressurizing of said interior by a compressed air source.

According to yet another aspect of the invention, it may be considered a method of mitigating rockfall events on a sloping surface, the method comprising: positioning a primary barrier layer having a width extending laterally across the sloping surface and a length extending down the sloping surface; installing a plurality of attenuators that are spaced laterally from one another and spaced laterally across the width of the primary barrier layer; securing a supporting cable to extend laterally across the sloping surface, wherein an upper portion of the primary barrier layer is attached to said supporting cable, and each of said plurality of attenuators are secured to said supporting cable; installing a first anchor point for securing a first end of said supporting cable and installing a second anchor point for securing a second opposite end of said supporting cable; and wherein each attenuator has a plurality of support members connected to one another in a geometric pattern, each support member having a first end connected to a first connector and a second end connected to a second connector, and further wherein each attenuator has a geometric shape with a plurality of sides formed by the support members connected in the geometric pattern.

According to this last-mentioned method, further optional features may include: wherein at least one attenuator of said plurality of attenuators traverses laterally along the sloping surface from a first position to a second different lateral position separated from the first position in response to a rockslide contacting said primary barrier or said plurality of attenuators; and wherein at least one attenuator of said plurality of attenuators moves vertically away from and separated from the sloping surface from a first position to a second different separated position separated from the first position in response to a rockslide contacting said primary barrier or said plurality of attenuators.

According to yet another aspect of the invention, it may be described as another system comprising a first barrier mounted on a sloping surface and a separate second barrier mounted adjacent thereto on a grade surface, this system comprising: (a) a first barrier mounted on the sloping surface comprising: a first barrier layer having a width extending laterally across the sloping surface and a length extending down the sloping surface; a plurality of first attenuators spaced laterally from one another and spaced laterally across the width of the first barrier layer, each of said first attenuators having a plurality of first support members connected to one another in a geometric pattern, each first support member having a first end connected to a first connector and a second end connected to a second connector, and wherein each first attenuator has a geometric shape with a plurality of sides formed by the first support members connected in the geometric pattern; a first supporting cable extending laterally across the sloping surface, wherein upper portions of the first barrier layer are attached to said first supporting cable, and each of said plurality of first attenuators are secured to said first supporting cable; and first anchor points for securing opposite lateral ends of said first supporting cable to the sloping surface; and (b) a second barrier mounted on the adjacent grade comprising: a second barrier layer having a width extending laterally across a grad surface; a plurality of second attenuators spaced laterally from one another and spaced laterally across the width of the second barrier layer, each of said second attenuators having a plurality of second support members connected to one another in a geometric pattern, each second support member having a first end connected to a first connector and a second end connected to a second connector, and wherein each second attenuator has a geometric shape with a plurality of sides formed by the second support members connected in the geometric pattern; a second supporting cable extending laterally across the grade surface, wherein upper portions of the second barrier layer are attached to said second supporting cable, and each of said plurality of second attenuators are secured to said second supporting cable; and second anchor points for securing opposite lateral ends of said second supporting cable to the grade surface.

According to yet another aspect of the system, it may be consider a system for mitigating rockfall events on a grade surface, the system comprising: a barrier layer having a width extending laterally across the grade surface and a length extending substantially perpendicular to the grade surface; a plurality of attenuators spaced laterally from one another and spaced laterally across the width of the barrier layer, each attenuator having a plurality of support members connected to one another in a geometric pattern, each support member having a first end connected to a first connector and a second end connected to a second connector, and wherein each attenuator has a geometric shape with a plurality of sides formed by the support members connected in the geometric pattern; a supporting cable extending laterally across the grade surface, wherein an upper portion of the barrier layer is attached to said supporting cable, and each of said plurality of attenuators are secured to said supporting cable; a first anchor point for securing a first end of said supporting cable; and a second anchor point for securing a second opposite end of said supporting cable.

According to the last mentioned system, it may further comprise at least one braking elements connected to the barrier layer for dissipating energy form an impact against the barrier layer; and at least one secondary anchor secured to said barrier layer to provide additional anchoring capability, said secondary anchor being spaced longitudinally from said barrier layer.

Other features and advantages of the invention will become apparent from a review of the following detailed description taken in conjunction with the drawings.

DETAILED DESCRIPTION

Figure 1:
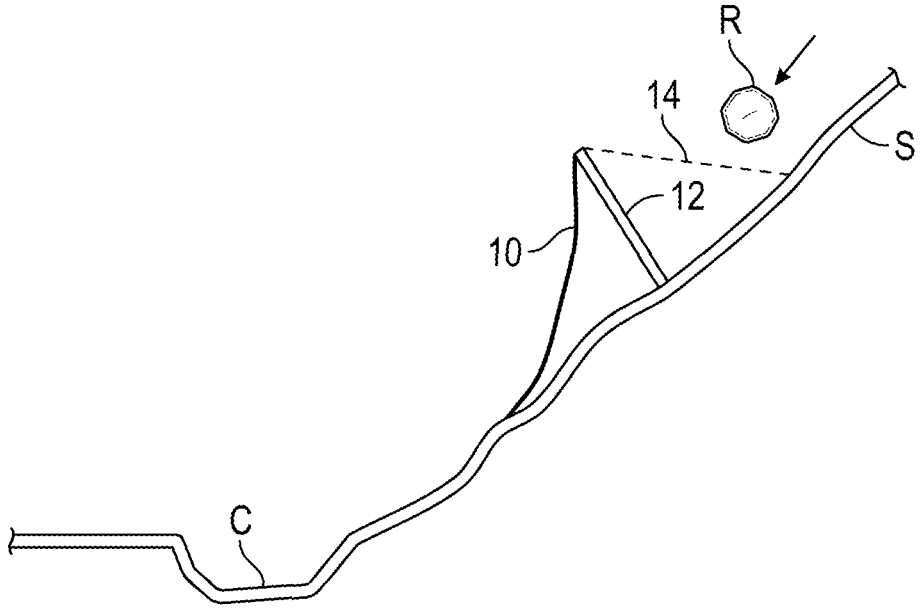
FIG. 1 (PRIOR ART)
FIG. 1 is a schematic view of a prior art barrier system.
Figure 2:
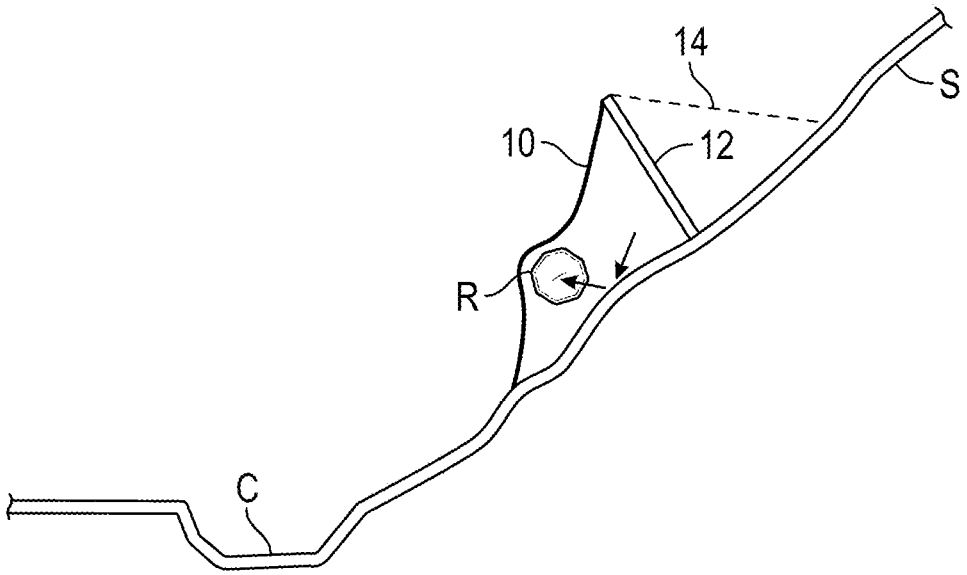
FIG. 2 (PRIOR ART)
FIG. 2 is a schematic view of the prior art barrier system performing under a rockslide event.

FIG. 1 illustrates a typical prior art barrier system mounted on a slope S comprising a plurality of posts 12, anchor cables 14, and one or more layers of barrier mesh 10 that extend down slope. The bottom of the slope may include a catch basin or channel C to trap any rocks/debris that might otherwise further travel into a restricted personnel or equipment area. As shown, a rock R is moving down slope, and in FIG. 2, the rock R is caught between the barrier mesh 10 and the slope S. The momentum of the rock R is slowed by contact with the barrier mesh with the presumption that the barrier system is designed to withstand the force of the falling rocks. As mentioned, there are number of drawbacks associated with the barrier system shown in FIGS. 1 and 2; each of the posts 12 must be installed with one or more rock bolts to support the posts. After the posts are installed, a support wire or cable is strung between adjacent posts. After installation of the support wire, the barrier mesh in one or more layers is then connected and installed. Each of these constructions steps is performed with little or no protection afforded to the workers who are installing the system. After a rockfall event, one or more of the posts may need to be replaced which requires significant additional effort to remove the damaged posts and reconnect the barrier mesh between the new posts.

Figure 3:
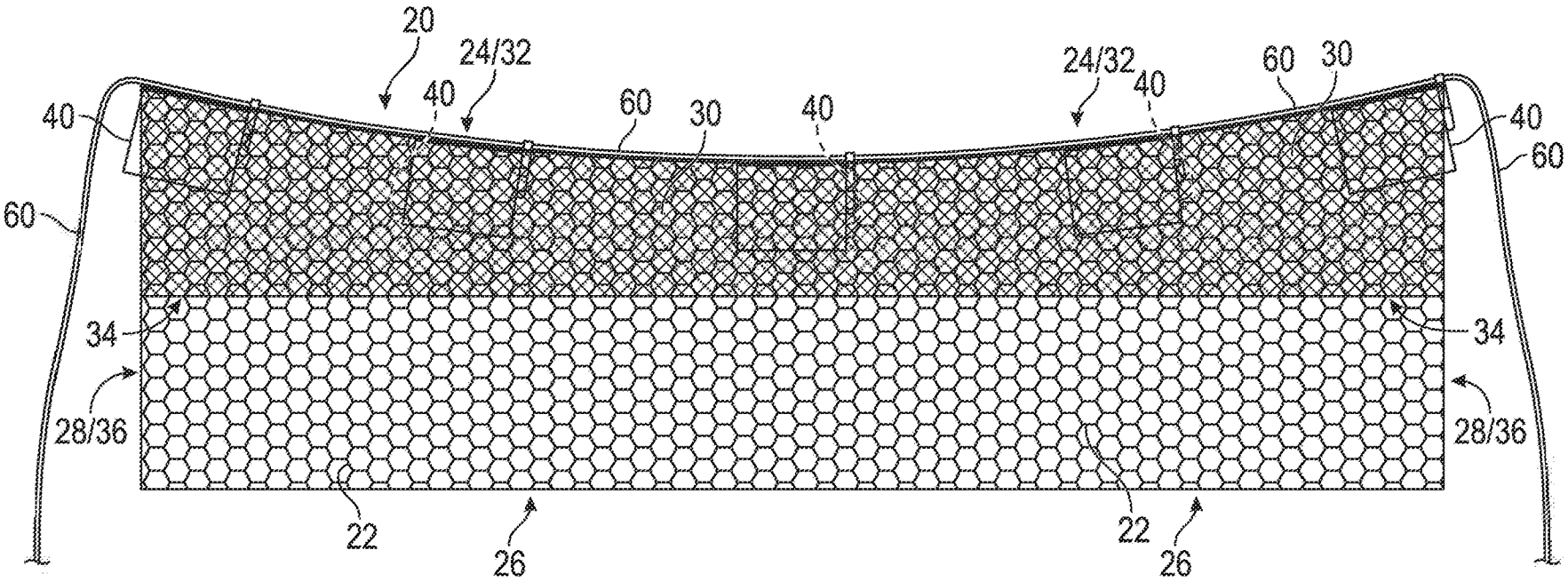
FIG. 3 is an elevation view of the barrier system of the invention.
Figure 5:
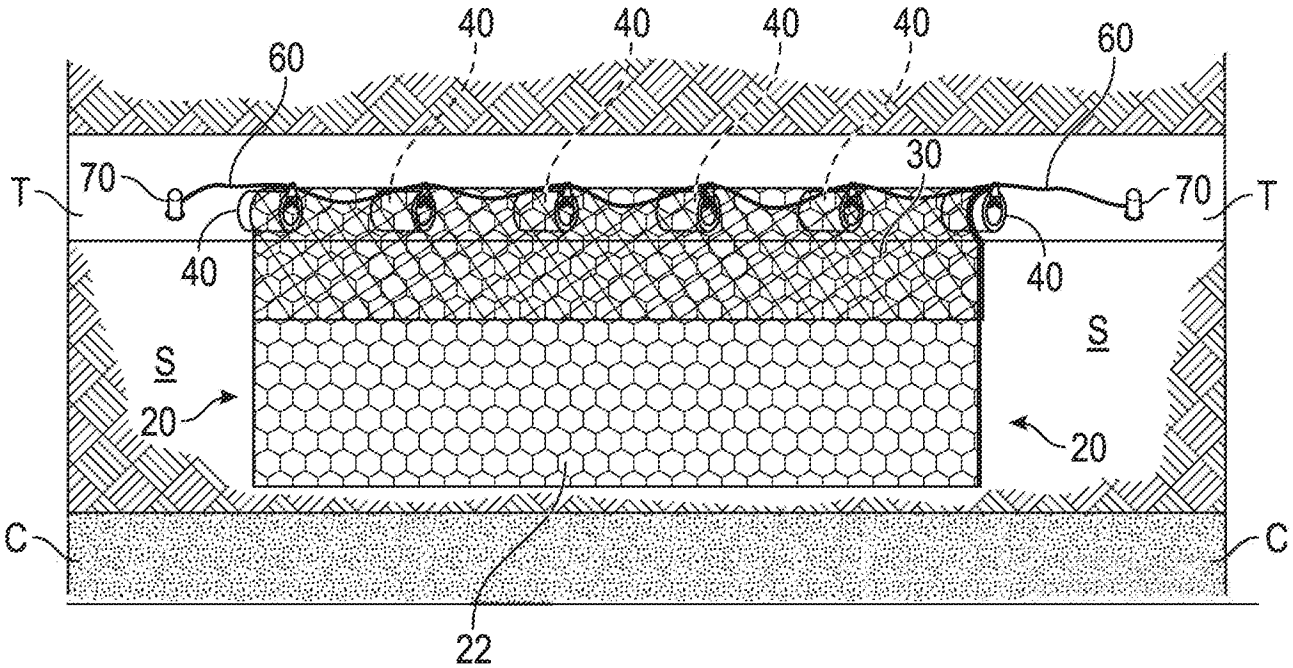
FIG. 5 is a plan view of the barrier system installed on a sloping surface.

Referring to FIGS. 3 and 5, a preferred embodiment of the barrier system 20 of the invention is illustrated. FIG. 3 provides an elevation view of the barrier system, while FIG. 5 provides a plan view of the system as installed on a sloping surface S. FIGS. 3 and 5 show the structural elements of the system which includes a primary barrier mesh 22 and one or more additional layers of secondary barrier mesh 30, such as finer and lighter mesh material as compared to the primary barrier mesh layer 22. As explained further below with respect to a method of installing the system, the layer of fine mesh 30 can be used to deploy the primary barrier mesh 22.

The primary barrier layer 22 is dimensioned so to cover a desired rockfall area; accordingly, the primary barrier layer 22 may be defined as having a top or upper edge 24, a bottom or lower edge 26, and corresponding lateral side edges 28. When deployed in use, one or more fine mesh layers 30 may also be sized to cover a desired rockfall area and to extend a desired distance laterally across and vertically down the slope. Accordingly, the fine mesh layer 30 also includes a top or upper edge 32, a bottom or lower edge 34, and the corresponding lateral side edges 36. In the example of FIG. 3, the fine mesh layer 30 extends partially down the height/length of the primary mesh 22 as shown.

The barrier system 20 further includes a plurality of laterally spaced attenuators or bumpers 40. The attenuators 40 are disposed at the top edges of the primary barrier layer 22 and secondary barrier layer(s) 30. Also referring to FIG. 5, a single supporting cable 60 is routed through corresponding attachment eyes 50 of each of the attenuators 40. The top edges of the primary and secondary barrier layer(s) are also secured to the supporting cable 60.

Although the attenuators 40 are shown in a configuration in which they extend laterally across the sloping surface and being laterally spaced from one another, it should be understood that the attenuators can be selectively arranged in other configurations so that the barrier layer(s) optimally cover a sloping surface. In this regard, the barrier system 20 further includes selective configurations for the attenuators in which one or more attenuators can be positioned downslope from other attenuators in addition to laterally spaced attenuators.

When installed as shown in FIG. 5, the barrier system also includes at least two anchors 70 in which each end of the supporting cable is secured to an anchor 70. The anchors 70 are mounted to a top portion T of the slope S in which the top or upper edges of the primary and secondary barriers are therefore spaced away from the surface of the slope so to catch or otherwise trap rock and debris that may fall downward during a rockfall event. Although the top portion T in this figure is shown as being on a relatively flat area, it should be understood that the anchors 70 can be secured to any flat or sloping part of the sloping surface S.

Figure 4:
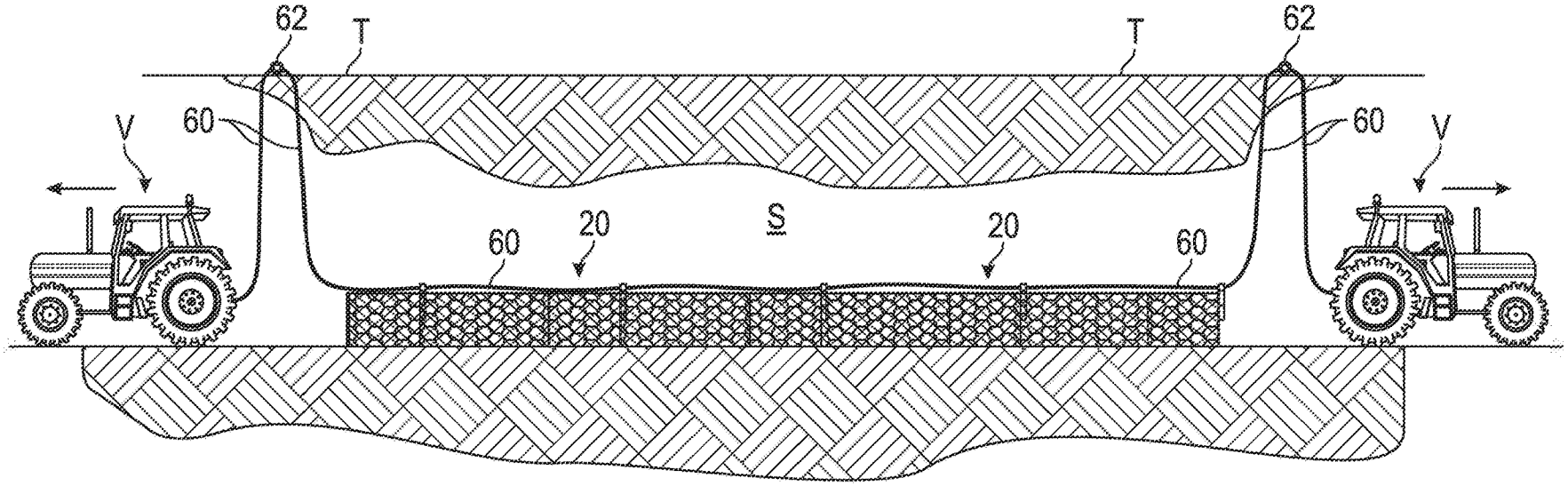
FIG. 4 is an elevation view of the barrier system during installation on a sloping surface.

Referring to FIG. 4, this shows one preferred method of installing the barrier system in which the barrier system is centered along a targeted rockfall area. As shown, each end of the supporting cable 60 is raised to a level that defines the most upper portion of the barrier system, such as the top portion T in the installed system shown in FIG. 5. Each end of the support cable is initially secured to an anchor point 70 and a pulley device 62 secured to the pulley device that may provide mechanical leverage for raising the support cable. Vehicles V or winches (not shown) may be used to raise the barrier system between the pair of pulleys 62 in which the vehicles travel in opposite directions to pull the ends of the supporting cable 60. As the vehicles V move, the barrier system will rise along the slope S until the support cable 60 is raised to a desired height. At this stage, the supporting cable 60 can be secured to the anchors 70. Selected tensioning of the cable 60 is contemplated to allow for a desired amount of lateral and vertical movement of the attenuators 40 in the event of a rockfall event.

As compared to the prior art, it should be apparent that the system 20 of the present invention is significantly easier to install because only two anchor points are required to support the primary and secondary barriers as opposed requiring the installation of a plurality of anchor points on the sloping surface. Additionally, the entire barrier system can be simultaneously raised by simply securing opposite ends of the support cable and providing a force to pull the opposite ends. In this way, workers and other personnel are much better protected during the installation process because the number of workers and/or the amount of time spent at the worksite is substantially minimized.

Figure 6:
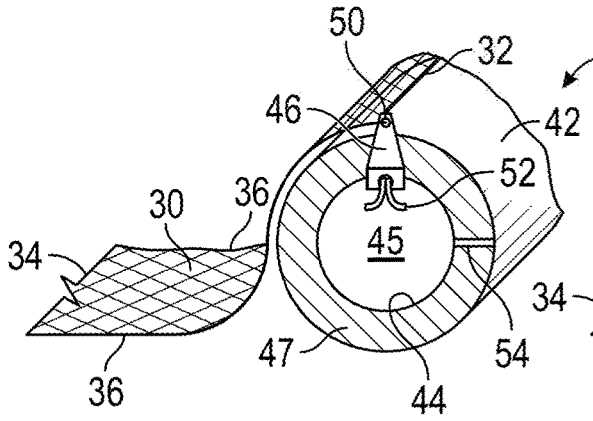
FIG. 6 is a fragmentary cross-sectional view of an attenuator and a barrier mesh secured thereto.

FIGS. 6-11 illustrate a method of deploying the barrier layers 22 and 30, along with details on one preferred embodiment for a construction of the attenuators 40. Referring first to FIG. 6, one example construction is provided for an attenuator 40 in which it has an outer surface 42, an interior surface 44, and a chamber 45 defining a hollow space. A cable-connecting flange 50 is incorporated through the sidewall 47 of the attenuator. The flange 50 includes an eye 50 which receives the support cable 60. The flange 50 is firmly held within the chamber 45 and against the interior surface 44 with the assistance of splines 52 or other securing elements to prevent the flange 50 from being pulled back through the sidewall 47. The attenuator is preferably made of a flexible and resilient material, such as a high-strength rubber compound. The attenuator 40 may be inflated to achieve a desired shape and volume so in this respect, it should be understood that the attenuator 40 can be selectively sized by inflation or deflation. An inflation port 54 is provided to selectively inflate/deflate the attenuator. The particular shape of the attenuator shown in FIGS. 6-11 is cylindrical; however, it should be understood that the attenuator may have other shapes such as spherical.

Figure 7:
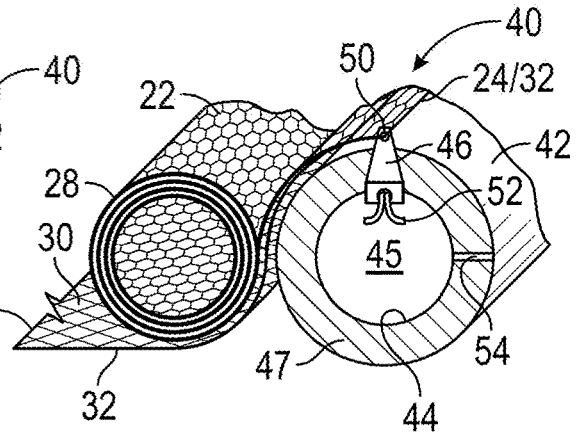
FIG. 7 is another fragmentary cross-sectional view of the attenuator and barrier mesh, along with a lightweight mesh also secured to the attenuator.
Figure 8:
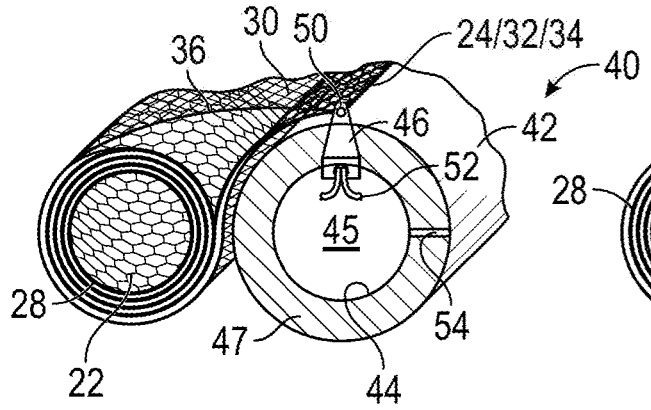
FIG. 8 is another fragmentary cross-sectional view of the attenuator, barrier mesh, and light weight mesh in which the lightweight mesh is secured at both ends to the attenuator for purposes of deploying the barrier mesh.
Figure 9:
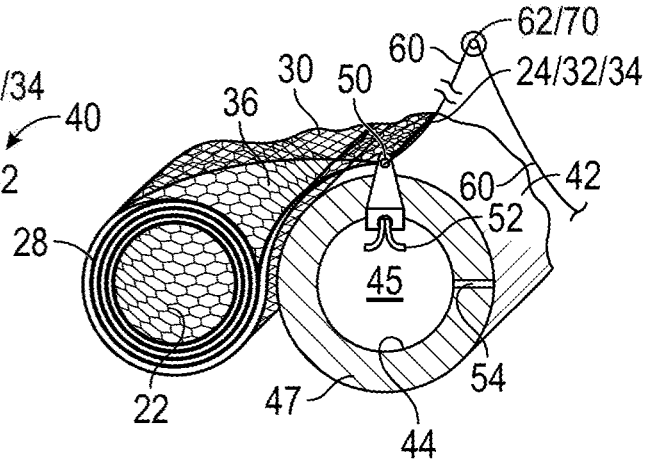
FIG. 9 is another fragmentary cross-sectional view of FIG. 8 further showing a single mounting cable attached to the attenuator, barrier mesh, and lightweight mesh.

According to a first step in preparation of the system for deployment as shown in FIG. 6, the primary barrier 30 has its upper or top edge 32 located adjacent the flange 46. According to a next step as shown in FIG. 7, the primary barrier 22 is provided in a rolled configuration, and its top or upper edge 24 is also located adjacent the flange 46. According to a next step as shown in FIG. 8, the lower or bottom edge 34 of the secondary barrier is pulled up to cover the primary barrier 22 and the bottom edge 34 is also located adjacent the flange 46. According to a next step as shown in FIG. 9, the support cable 60 is routed through the eye 50 of the flange 46 thereby securing the top edge 24 of the primary barrier, and the top and bottom edges 32 and 34 of the secondary barrier. In this configuration, the secondary barrier 30 serves as a supporting wrap or supporting basket for the primary barrier 22.

Figure 10:
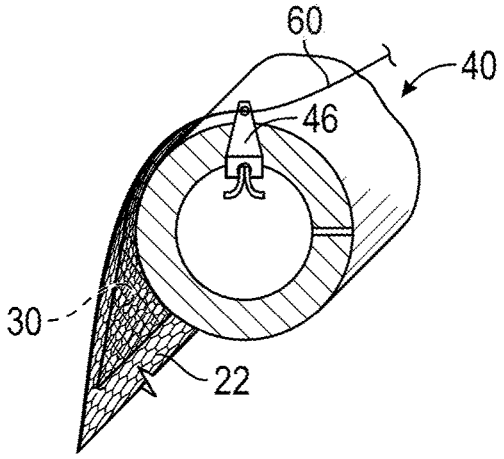
FIG. 10 is another fragmentary cross-sectional view of FIG. 9 showing the barrier system deployed in which one end of the lightweight mesh is released to allow the barrier mesh to unroll.

FIG. 10 shows deployment of the barrier layers in which the bottom edge 34 of the secondary barrier layer is released which allows the primary barrier layer 22 to unroll and therefore extend down over the sloping surface.

Figure 11:
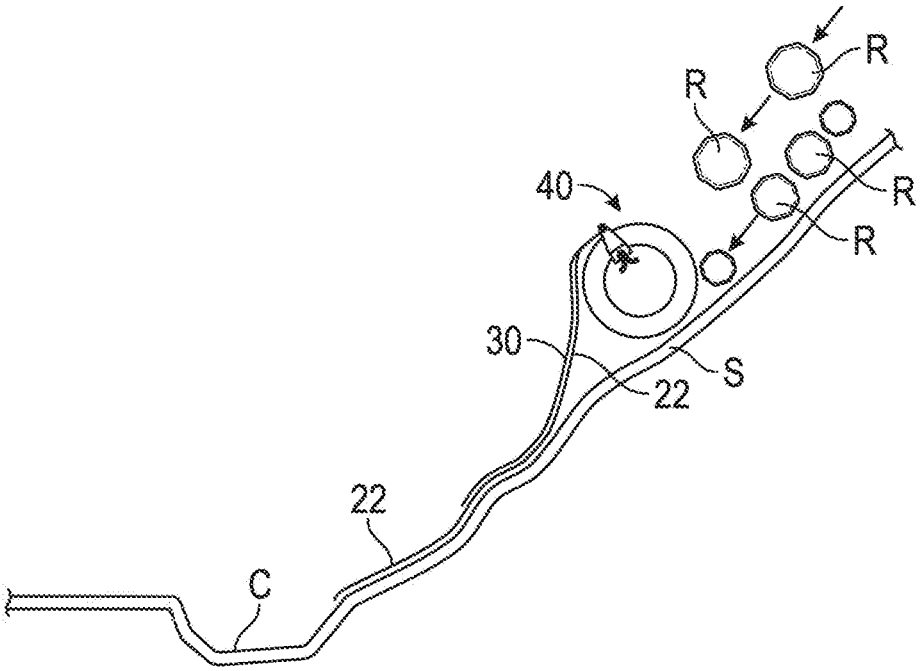
FIG. 11 is a schematic view of the system of the invention prior to a rockfall event.

FIG. 11 is a schematic side view of the system of the invention as installed on a sloping surface S. Specifically, FIG. 11 illustrates a rock fall attenuator 40 with a primary barrier layer 22 and a secondary barrier layer 30 extending down the slope. A group of rocks R from a rock fall approach the system.

Figure 12:
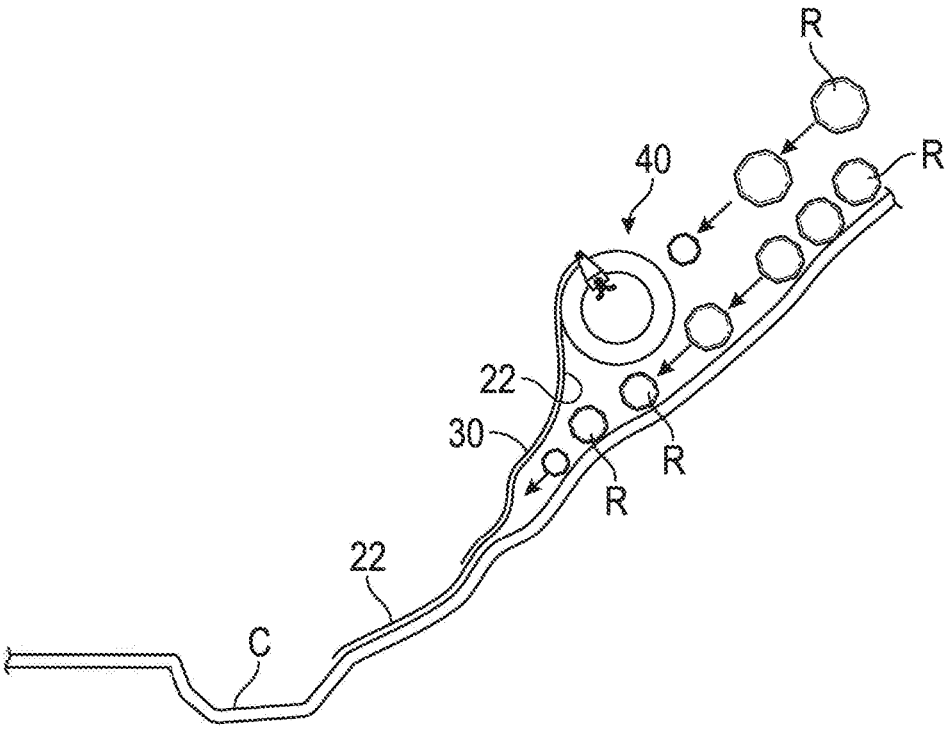
FIG. 12 is another schematic view of the system of the invention during a rockfall event in which an attenuator can be displaced vertically and/or laterally in response to the force of the falling rocks.

FIG. 12 illustrates a rockfall event in which the attenuator 40 may be displaced upward away from the slope S as caused by rocks which may strike the attenuator and those rocks which may therefore travel underneath the attenuator. As also mentioned, the attenuator may also react to the force of a rock fall by lateral movement along the slope in which, depending upon the tension placed on the support cable 60, the attenuator will have at least some ability to laterally displace. During a rockfall event, it is also possible that rocks will not have sufficient force to vertically raise or laterally displace the attenuators in which case, the attenuators may experience some slight movement on the slope, but in any event, will remain in place to allow rocks to pass between the attenuators. Another advantage of the attenuators is that rocks making a direct hit on the attenuators will be slowed since the attenuators themselves have an inherent energy absorption feature by incorporation of the rubber composite material along with an inflatable characteristic enabling the attenuators to deform in response to force from a striking rock.

Figure 13:
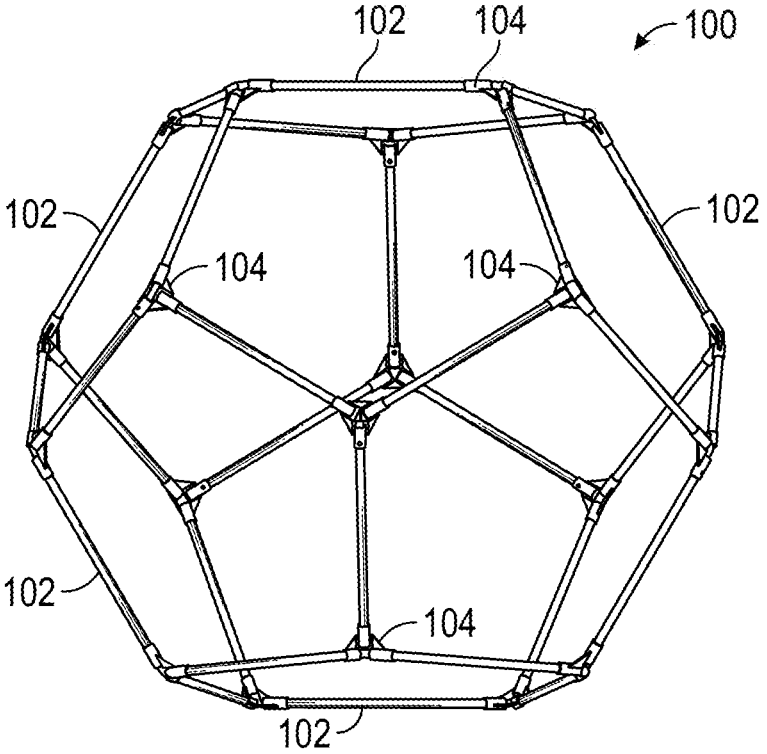
FIG. 13 is a perspective view of another embodiment of an attenuator comprising interconnected support members forming a framed attenuator structure.

FIG. 13 is a perspective view of another embodiment of an attenuator 100 comprising interconnected support members 102 forming a framed attenuator structure. As illustrated, the support members 102 are interconnected by respective connectors 104. One way to describe the interconnected support members is that they are connected to one another in a geometric pattern, each support member having a first end connected to a first connector and a second end connected to a second connector. According to this construction, the attenuator 100 therefore has a geometric shape with a plurality of sides formed by the support members connected in the geometric pattern. The specific geometric shape illustrated in FIG. 13 is a polyhedron having twelve faces, that is, a dodecahedron. Each of the faces is defined by five support members that form a pentagon shape in which each connector 104 therefore interconnects three ends of adjacent supports 102. These adjacent supports 102 have opposite ends that that extend angularly away from one another at approximately 108°. The attenuator structure can be described as being "framed" in that the support members form a frame-like structure without any other elements making up the attenuator. Accordingly, open spaces exist between each of the support members 102.

Figure 14:
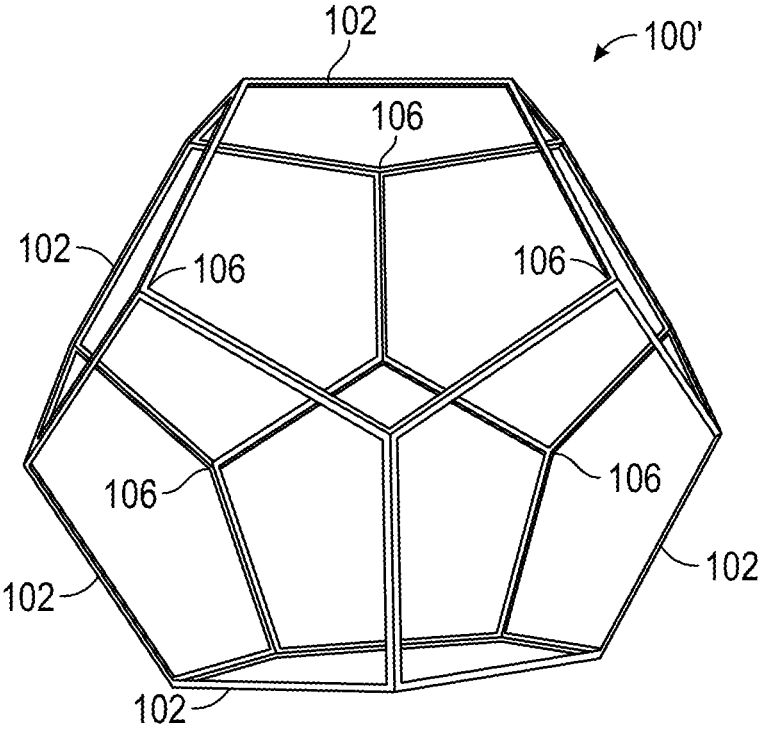
FIG. 14 is a perspective view of another embodiment of an attenuator forming a framed attenuator structure.

FIG. 14 is a perspective view of another embodiment of an attenuator 100' forming a framed attenuator structure similar to the attenuator 100 of FIG. 13. The difference in this particular embodiment is that instead of utilizing connectors 104, converging ends of adjacent support members 102 are simply joined to one another, such as by welding thereby forming integral connections 106. Otherwise, the same characteristics apply to the embodiment of FIG. 14 with respect to its ability to perform as an attenuator.

Figure 15:
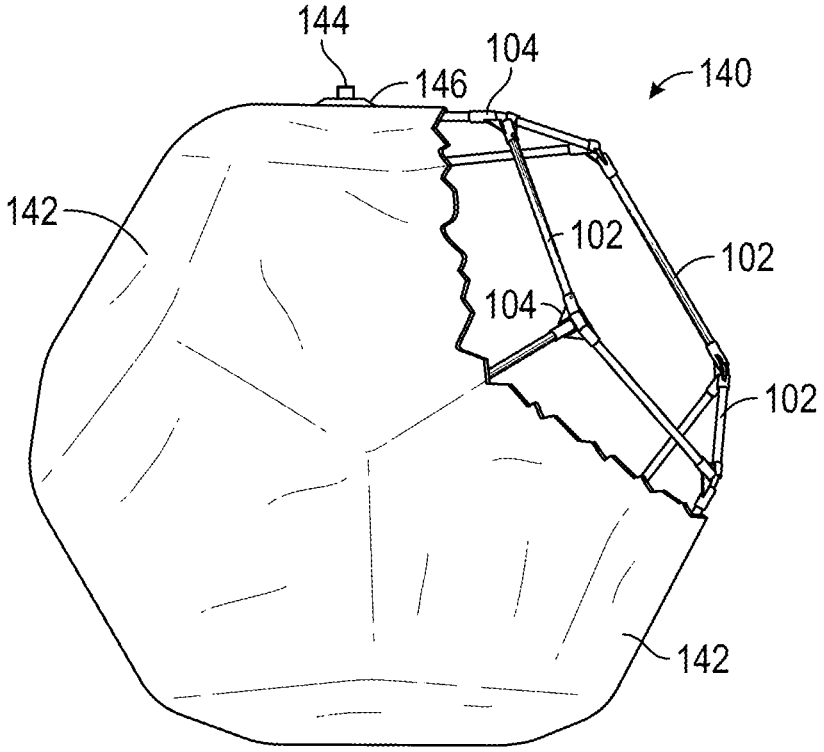
FIG. 15 is a perspective view of another embodiment of an attenuator comprising a framed attenuator structure and a resilient cover placed over the support members.

FIG. 15 is a perspective view of another embodiment of an attenuator 140 comprising a framed attenuator structure and a resilient cover 142 placed over the support members 102. The particular arrangement of support members is the same as shown with respect to the embodiment of FIG. 13; however, this particular embodiment is not limited to any particular arrangement of support members. One advantageous characteristic of this embodiment however is that it maintains a polyhedron shape. Like the attenuator 40, the attenuator 140 has the resilient cover 142 that is preferably made of a flexible and resilient material, such as a rubber compound. The attenuator 140 is also inflatable to achieve a specific desired shape and volume. So again, the attenuator 140 can also be selectively sized by inflation or deflation in addition to sizing by use of the support members. Also illustrated in this embodiment is an inflation port 144 and an inflation base 146 to assist in mounting the inflation port to the cover 142.

Although a dodecahedron is illustrated in the embodiments of FIGS. 13-15, it is also contemplated within the scope of the invention that the attenuators 100, 100' and 140 can be other polyhedron shapes comprising support members connected to one another in various geometric patterns. The dodecahedron shape is particularly advantageous because structurally, it has a general spherical shape characteristic that enables it to shift or move upon impact without constraint by a side or edge that is particularly vulnerable to an impact that would otherwise constrain movement. Other polyhedron shapes that may be considered in the present invention include, without limitation, dodecahedrons, hexakis tetrahedrons, octahedrons, icosahedrons and trapezoidal dodecahedrons.

Figure 16:
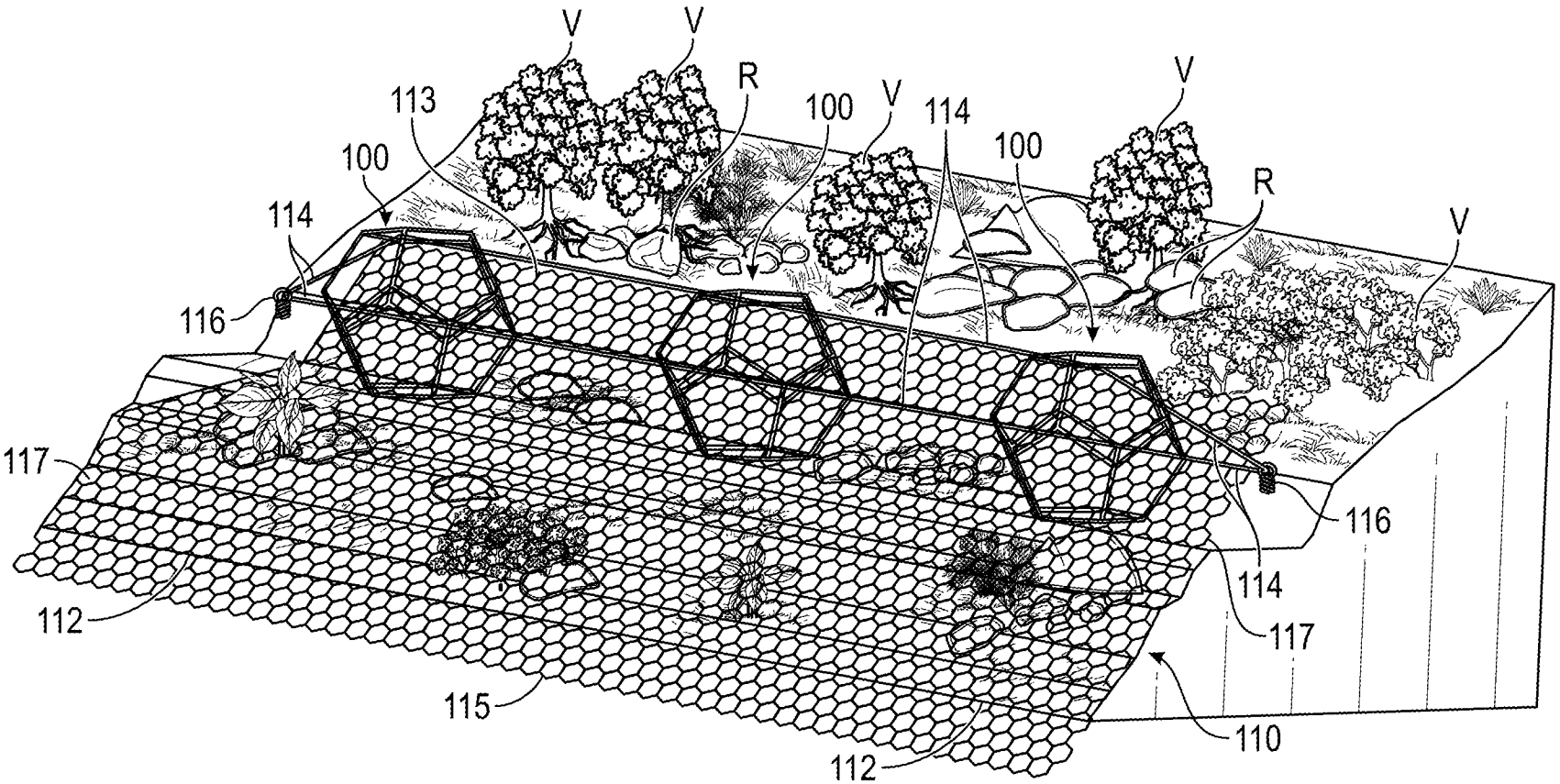
FIG. 16 is a fragmentary cross-sectional view of a barrier system including attenuators, a barrier mesh secured thereto, and a laterally extending anchor cable.

FIG. 16 is a fragmentary cross-sectional view of another barrier system 110 mounted on a sloping surface. The sloping surface is shown with typical features including rocks R and vegetation V. The barrier system 110 includes a plurality of attenuators 100, a barrier mesh layer 112 secured thereto, and a laterally extending anchor cable 114. Although attenuators 100 are shown, the attenuators 100' or 140 may be installed, or a selected combination of the attenuators 100, 100' and 140. Accordingly, it should be understood that the barrier system 110 is not limited to just a single type of attenuator. The barrier system 110 is illustrated as having a single barrier mesh, but one or more additional layers of secondary barrier mesh may be added to the system, similar to the embodiments shown in FIGS. 3 and 5.

The barrier mesh layer 112 is dimensioned to cover the desired rockfall area. Accordingly, the barrier mesh layer 112 may be defined as having a top or upper edge 113, a lower or bottom edge 115, and corresponding lateral side edges 117.

The attenuators 140 are shown as mounted to the barrier mesh at the upper edge thereof. The support cable 114 is also connected to the top edge of the barrier mesh and connected to each of the attenuators 100. A specific configuration of the support cable 114 shows that it has an elevated portion or length that extends laterally across the barrier layer 112, is connected to the top edge of the barrier layer and connected to an elevated portion of the attenuators 100. Opposite sides of the elevated portion or length are secured to lateral anchors 116. The support cable has another portion or length that extends beneath the elevated portion, laterally across the barrier layer 112, and also connected to the lateral anchors 116. One advantage of the system 10 is that it minimizes insulation installation efforts by only requiring two lateral anchors 116, as compared to many prior art systems which require many more anchors.

As with the system embodiment shown in FIGS. 3 and 5, although the attenuators 140 are shown in a configuration in which they extend laterally across the sloping surface and laterally spaced from one another, it should be understood that the attenuators can be selectively arranged in other configurations so that the barrier layer(s) optimally cover a sloping surface. Accordingly, attenuators 140 can be provided that are positioned downslope from other attenuators in addition to the laterally spaced attenuators.

Figure 17:
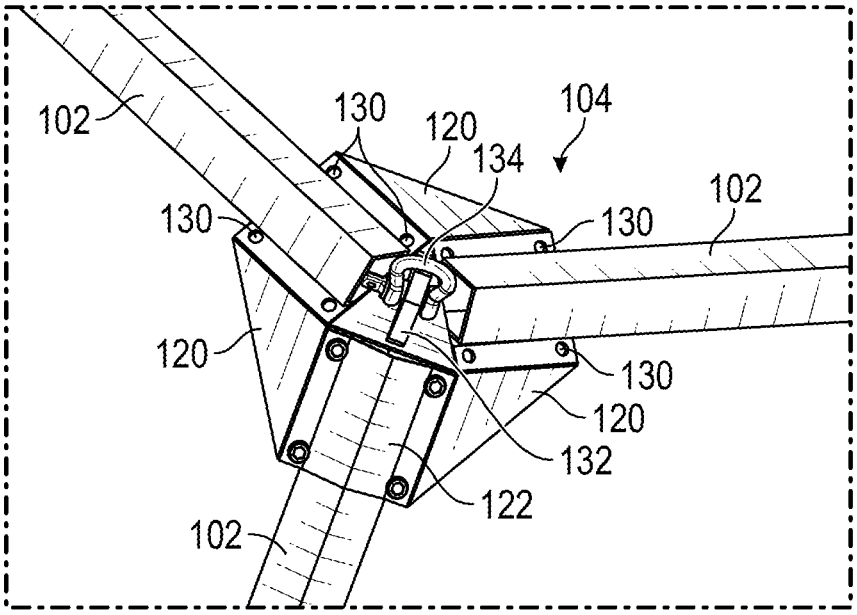
FIG. 17 is an enlarged plan view of a connection for interconnecting three adjacent ends of support members from the embodiment of FIG. 13.
Figure 18:
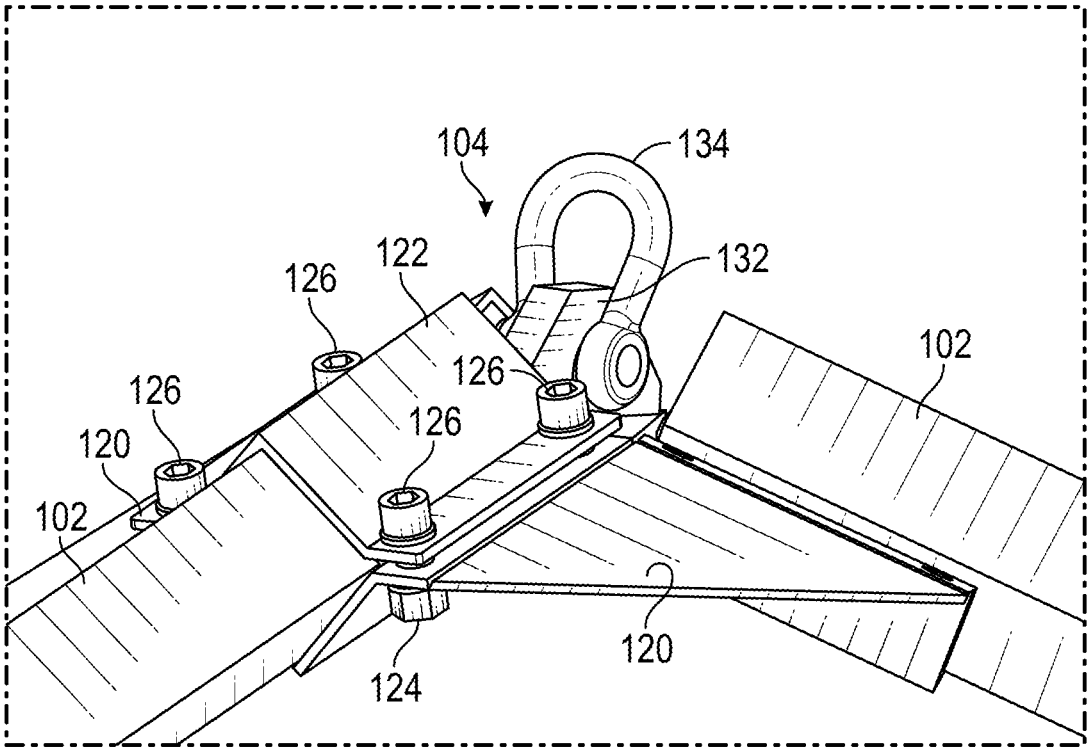
FIG. 18 is an enlarged perspective view of the connection for interconnecting the three adjacent ends of support members from the embodiment of FIG. 13.

FIG. 17 is an enlarged plan view of a connection for interconnecting three adjacent ends of support members 102 from the embodiment of FIG. 13. FIG. 18 is an enlarged perspective view of the connection for interconnecting the three adjacent ends of support members. More specifically, the connection comprises a connector 104 having three triangular shaped brackets 120 having threaded openings 130 located adjacent the ends of the support members 102. A V-shaped bracket clamp 122 has openings that align with the openings 130. Threaded bolts 126 and nuts 124 are used to tighten the bracket clamps against the respective parts of the brackets 120. A single V-bracket clamp 122 is shown in these two figures, it being understood however that there would be a total of three clamps 122 thereby securing the three respective ends of the support members 102 to the connector 104. FIGS. 17 and 18 also illustrate a clevis mount 132 and clevis 134 that can be used to receive and secure the support cable 114 as well as to secure desired portions of the barrier layer 112. The clevis 134 may also be used for lifting and manipulation of the structure during transport and installation.

Figure 19:
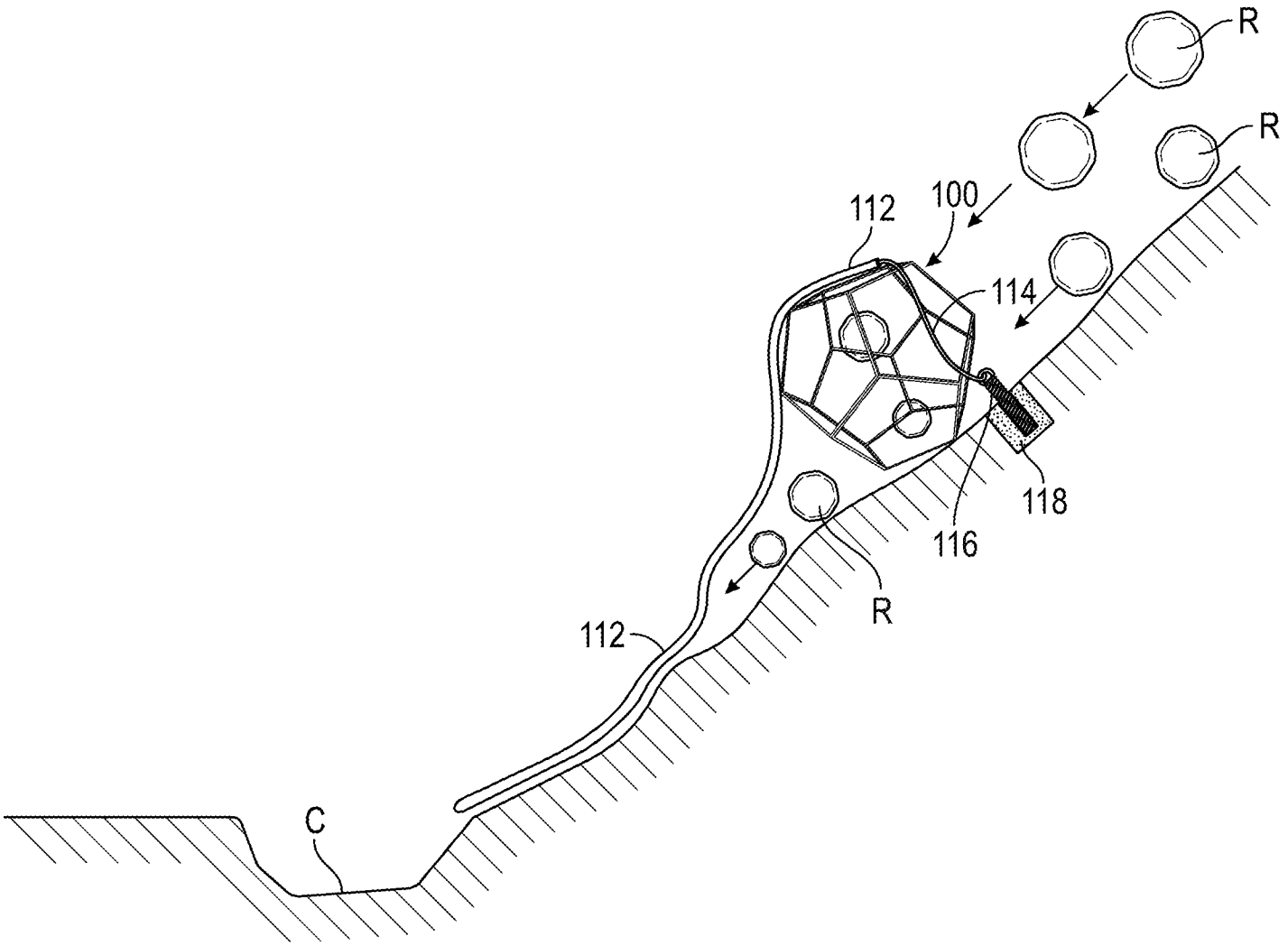
FIG. 19 is a schematic view of the system of the invention during a rockfall event in which the illustrated attenuator of FIG. 13 can be displaced vertically and/or laterally in response to the force of the falling rocks, and further where the open spaces or gaps between support members allow rocks and debris to pass therethrough.

FIG. 19 is a schematic view of the system of the invention during a rockfall event in which the illustrated attenuator can be displaced vertically and/or laterally in response to the force of the falling rocks. As also shown, the open spaces or gaps between support members 102 allow rocks R and debris to pass therethrough. While not all of the rocks and debris will pass unimpeded through the attenuator, the open frame construction of the attenuator facilitates maximum passage of the rock and debris downslope and under the barrier layer 112. FIG. 19 also illustrates schematically an example of a grouted anchor hole 118, which may be one preferable manner in which to adequately embed the anchor 116 against the slope. However, other methods of anchoring the anchor 116 may be adopted, depending upon the expected force of a rockfall that the system may encounter.

One particular advantage of the attenuators 100 and 100' is that rock and debris passing through the attenuators may minimize displacement of the attenuator during a rockfall event. In the event that a particularly large rock or portion of debris cannot pass through the attenuators, the generally spherical presentation of the attenuators still enable the attenuators to shift or move in a manner to prevent a contact force that would trap, immobilize and unduly damage the attenuators.

Installation of the barrier system 110 can be achieved in the same manner as installation of the barrier system 20 in which the entire barrier system can be raised with pulleys located at each lateral anchor point.

Figure 20:
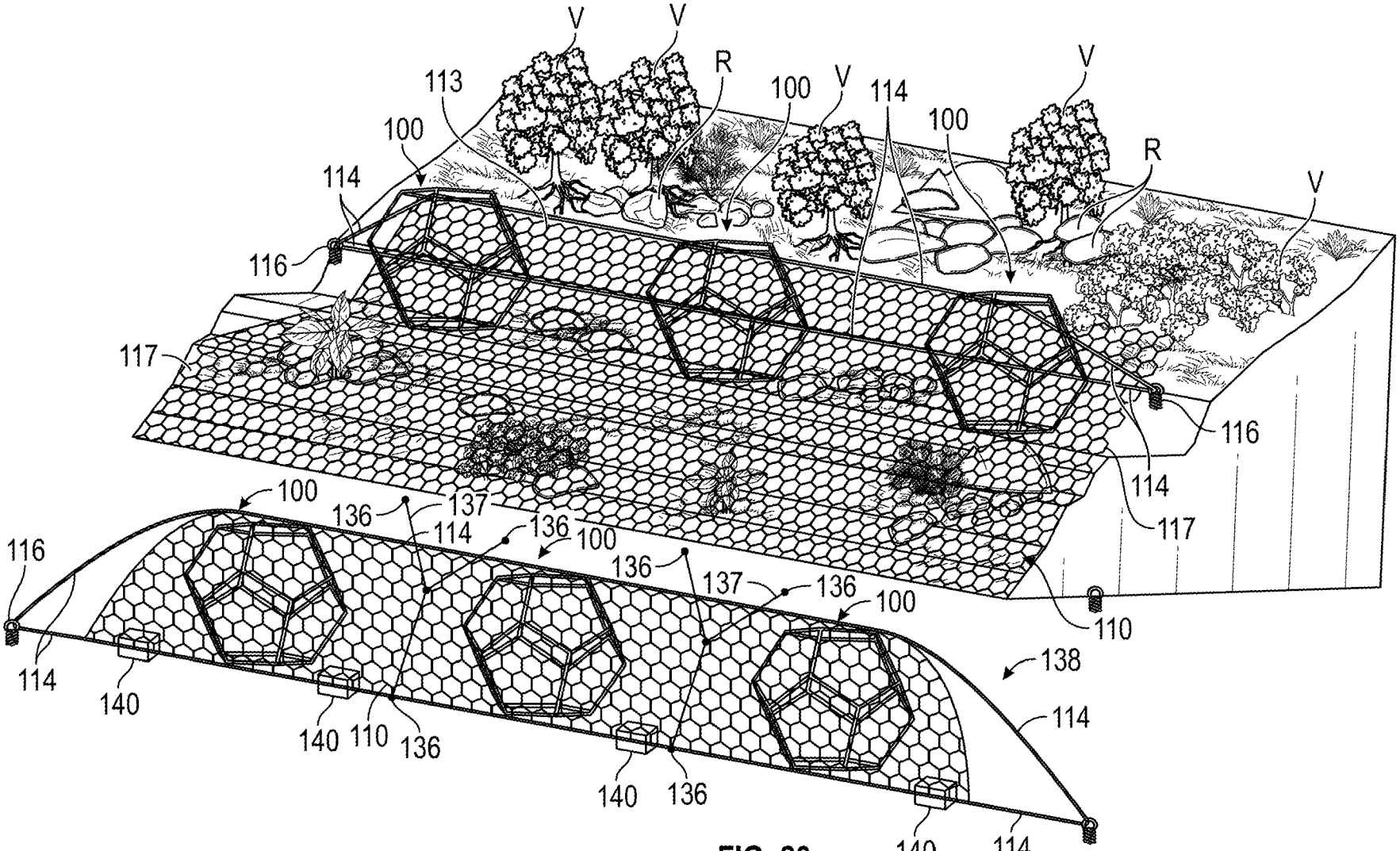
FIG. 20 is a fragmentary cross-sectional view of the barrier system of the invention that further comprises an additional barrier located at grade and below the adjacent sloping surface where the barrier system is installed.
Figure 21:
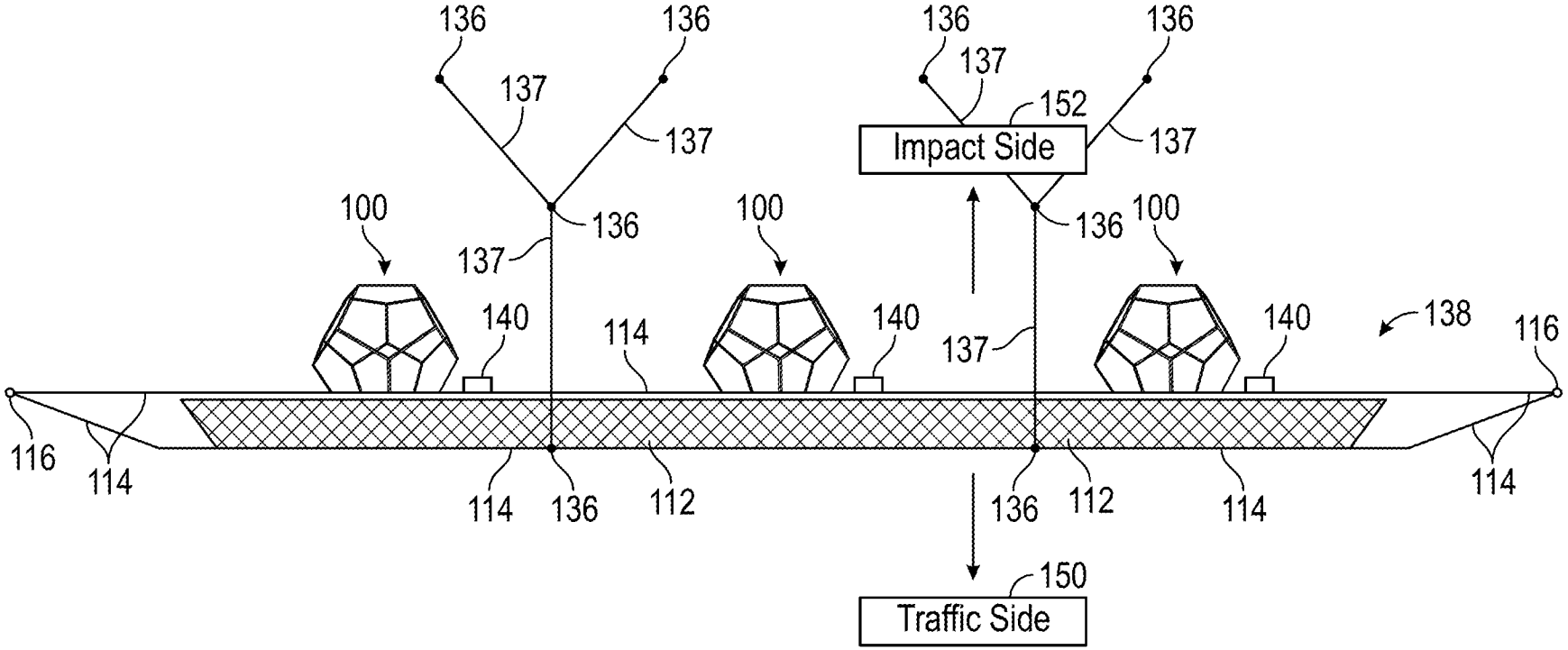
FIG. 21 is a plan view of the barrier located at grade showing details including spaced attenuators facing an impact side of the barrier towards the sloping surface.

FIG. 20 is a fragmentary cross-sectional view of the barrier system 110 of the invention that further comprises an additional barrier 138 located at grade and below the adjacent sloping surface where the barrier system 110 is installed. FIG. 21 is a plan view of the barrier located at grade showing details including spaced attenuators 100 facing an impact side 152 of the barrier towards the sloping surface. More specifically, FIG. 20 shows the additional barrier 138 in a position which is spaced from the system 110, such as on a grade level of a roadway, a man-made facility, or some other area below the slope that requires rockfall mitigation. The length of the barrier 138 is intended to be illustrated such that it is at least as long as the system 110 or longer, so that if rocks or other debris pass through the system 110, they are caught and/or disrupted by the barrier 138.

While barrier 138 is shown with the system 110, it should be understood that in many applications, the barrier 138 would be the only barrier provided and therefore should also be considered a separate system. Accordingly, the barrier 138 should also be considered an additional embodiment of the invention.

The construction of the barrier 138 is similar to the system 110 in that it includes a plurality of spaced attenuators 100 with an upper edge or portion of the barrier mesh layer 112 secured by an upper length of support cable 114 to the attenuators 100. The barrier mesh layer 112 is secured at its lower end to a lower length of the cable support 114. The lengths of support cable 114 are also shown as being secured to the ground by respective lateral anchors 116. Preferably, the attenuators 100 are mounted on the impact side 152 of the barrier mesh layer so that the barrier mesh layer 112 faces the traffic side 150, for example, of a roadway (not shown).

As with the attenuators 100 of the system 110, the attenuators 100 of the barrier 138 can be sized and spaced from one another so that the barrier 138 serves its intended purpose as a supplemental or additional means of protection.

The barrier 138 is also illustrated as having braking elements 140 which are intended to represent various energy dissipating devices that may be incorporated with the barrier 138. These braking elements can be installed on any of the lengths of cable supports 114 or secured to the barrier mesh layer 112 itself. The braking elements 140 act as energy dissipating devices that absorb energy generated by an impact, thereby reducing mechanical stresses in the barrier mesh layer 112. For example, if a braking element is installed on a length of cable, the braking element allows some flexing or displacement of the cable upon which it is installed. This flexing action is intended to prevent the barrier mesh layer from completely failing which could occur if the energy of an impact were entirely absorbed by the barrier mesh layer. In other words, the additional strength provided by the braking elements allows the barrier mesh layer greater ability to flex, stretch, or to otherwise displace without breakage or failure. Examples of braking elements that may be used with the barrier may include, but are not limited to, the shock absorbing devices described in the U.S. Pat. Nos. 6,131,873 and 7,458,449. These two references are incorporated by reference herein for teaching exemplary braking elements that could be used with the barrier 138.

FIGS. 19 and 20 further illustrate additional or secondary anchors 136 that can be installed to provide further anchoring support to the barrier. As shown, the anchors 136 can be installed immediately adjacent the barrier mesh layer 112, spaced longitudinally from the barrier mesh layer, or combinations thereof. Connecting cables 137 are also shown which interconnect installed anchors 137. Preferably, the secondary anchors are installed upslope from the barrier mesh layer.

While the barrier system 110 is intended to stop rockfall and other debris from travelling onto an adjacent grade such as a roadway, the barrier 138 may serve as an additional or supplemental protection device so that even smaller rock or debris is not capable of passing through the system 110 to the adjacent grade. As also mentioned, the barrier 138 may also be considered a separate embodiment that can be installed by itself for mitigation purposes.

From the foregoing, it should be apparent that there many structural features of the invention that provide benefits over the prior art. The attenuators achieve an enhanced function for raising the barrier layer(s) away from the slope without requiring any of the attenuators to be actually attached to the slope. Installation or deployment of the system is simplified by use of a single support cable that may be raised to a desired height by only two anchor points. The physical force required to raise the barrier may be achieved simultaneously by opposite traveling vehicles or opposite pulling winches that pull opposite ends of the supporting cable.

There are numerous advantages of the invention. The system is easily installed since anchoring of the system is simplified with two primary anchor points in which the entire barrier can be raised with pulleys located at each anchor point. This simplified method of deploying the system makes the system a mobile solution for rockfall mitigation. The same system can be re-used in multiple installations because the attenuators are pre-secured to the barrier layers and because the attenuators are not permanently attached to the sloping surface of the rockfall area. Use of pulleys to raise and lower the barrier system allows it to be deployed and removed with existing equipment, such as jobsite vehicles, that can supply the needed force for raising and lowering the barrier system. The attenuators can be selectively arranged at various locations on the primary barrier to account for the specific shape or orientation of the sloping surface therefore enabling the system to be installed at many locations.

Although the invention is described herein with respect to various preferred embodiments relating to a system, method, and sub combinations of the system, it shall be understood that the invention can be modified beyond the specific disclosure of the preferred embodiments commensurate with the scope of the claims appended hereto.

What is claimed is:

1. A system for mitigating rockfall events on a sloping surface, the system comprising:

a barrier layer having a width extending laterally across the sloping surface and a length extending down the sloping surface;

a plurality of attenuators spaced laterally from one another and spaced laterally across the width of the barrier layer, each attenuator having a plurality of support members connected to one another in a geometric pattern, each support member having a first end connected to a first connector and a second end connected to a second connector, and wherein each attenuator has a geometric shape with a plurality of sides formed by the support members connected in the geometric pattern;

a supporting cable extending laterally across the sloping surface, wherein an upper portion of the barrier layer is attached to said supporting cable, and each of said plurality of attenuators are secured to said supporting cable;

a first anchor point for securing a first end of said supporting cable; and a second anchor point for securing a second opposite end of said supporting cable.

2. The system, as claimed in claim 1, wherein:

said barrier includes a mesh configuration.

3. The system, as claimed in claim 1, wherein:

said attenuators are substantially evenly spaced from one another laterally across the width of the primary barrier layer.

4. The system, as claimed in claim 1, wherein:

said attenuators are each of substantially a same size and shape.

5. The system, as claimed in claim 1, wherein:

said attenuators include at least one attenuator that has a substantially different size and shape as compared to other attenuators.

6. The system, as claimed in claim 1, wherein:

space between each of said plurality of support members is open, and wherein an interior of each attenuator is open.

7. An energy absorbing attenuator especially adapted for use within a rockfall mitigation system, said attenuator comprising:

a plurality of support members connected to one another in a geometric pattern; each support member having a first end connected to a first connector and a second end connected to a second connector;

each attenuator having a geometric shape with a plurality of sides formed by the support members connected in the geometric pattern; and wherein space between each of said plurality of support members is open and wherein an interior of each attenuator is open thereby forming a framed attenuator structure.

8. The attenuator, as claimed in claim 7, further comprising:

a clevis attached to one of said connector.

9. The attenuator, as claimed in claim 7, wherein:

said plurality of support members are constructed of at least one of aluminum, iron or steel.

10. The attenuator, as claimed in claim 7, wherein:

said plurality of support members are constructed of carbon fibers or metallic tubing.

11. The attenuator, as claimed in claim 7, wherein:

said carbon fibers or metallic tubing includes square tubing.

12. The attenuator, as claimed in claim 7, further including:

an exterior covering placed over said plurality of support members.

13. The attenuator, as claimed in claim 12, wherein:

the exterior covering is made of a flexible elastomeric material.

14. The attenuator, as claimed in claim 12, wherein:

the exterior covering is continuous over said plurality of support members.

15. The attenuator, as claimed in claim 12, wherein:

the exterior covering is continuous over said plurality of support members and wherein the interior of said attenuator is pressurized.

16. The attenuator, as claimed in claim 15, further including:

a valve secured to said exterior covering for controlling pressurizing of said interior by a compressed air source that thereby inflates said exterior covering.

17. A method of mitigating rockfall events on a sloping surface, the method comprising:

positioning a primary barrier layer having a width extending laterally across the sloping surface and a length extending down the sloping surface;

installing a plurality of attenuators that are spaced laterally from one another and spaced laterally across the width of the primary barrier layer;

securing a supporting cable to extend laterally across the sloping surface, wherein an upper portion of the primary barrier layer is attached to said supporting cable, and each of said plurality of attenuators are secured to said supporting cable;

installing a first anchor point for securing a first end of said supporting cable and installing a second anchor point for securing a second opposite end of said supporting cable; and wherein each attenuator has a plurality of support members connected to one another in a geometric pattern, each support member having a first end connected to a first connector and a second end connected to a second connector, and further wherein each attenuator has a geometric shape with a plurality of sides formed by the support members connected in the geometric pattern.

18. A method, as claimed in claim 17, wherein:

at least one attenuator of said plurality of attenuators traverses laterally along the sloping surface from a first position to a second different lateral position separated from the first position in response to a rockslide contacting said primary barrier or said plurality of attenuators.

19. A method, as claimed in claim 17, wherein:

at least one attenuator of said plurality of attenuators moves vertically away from and separated from the sloping surface from a first position to a second different separated position separated from the first position in response to a rockslide contacting said primary barrier or said plurality of attenuators.

20. A system for mitigating rockfall events on a sloping surface, the system comprising:

a barrier layer having a width extending laterally across the sloping surface and a length extending down the sloping surface;

a plurality of attenuators spaced laterally from one another and spaced laterally across the width of the barrier layer, each of said attenuators having a plurality of support members connected to one another in a geometric pattern, each support member having a first end connected to a first connector and a second end connected to a second connector, and wherein each attenuator has a geometric shape with a plurality of sides formed by the support members connected in the geometric pattern;

a supporting cable extending laterally across the sloping surface, wherein upper portions of the barrier layer is attached to said supporting cable, and each of said plurality of attenuators are secured to said supporting cable; and first and second anchor points for securing opposite ends of said supporting cable to the sloping surface.

21. A system, as claimed in claim 20, wherein:

said attenuators are substantially evenly spaced from one another laterally across the width of the primary barrier layer.

22. A system, as claimed in claim 14, wherein:

said attenuators are each of substantially a same size and shape.

23. A system, as claimed in claim 14, wherein:

said attenuators include at least one attenuator that has a substantially different size and shape as compared to other attenuators.

24. A system for mitigating rockfall events on a sloping surface and an adjacent grade, the system comprising:

(a) a first barrier mounted on the sloping surface comprising:

a first barrier layer having a width extending laterally across the sloping surface and a length extending down the sloping surface;

a plurality of first attenuators spaced laterally from one another and spaced laterally across the width of the first barrier layer, each of said first attenuators having a plurality of first support members connected to one another in a geometric pattern, each first support member having a first end connected to a first connector and a second end connected to a second connector, and wherein each first attenuator has a geometric shape with a plurality of sides formed by the first support members connected in the geometric pattern;

a first supporting cable extending laterally across the sloping surface, wherein upper portions of the first barrier layer are attached to said first supporting cable, and each of said plurality of first attenuators are secured to said first supporting cable; and first anchor points for securing opposite lateral ends of said first supporting cable to the sloping surface; and (b) a second barrier mounted on the adjacent grade comprising:

a second barrier layer having a width extending laterally across a grad surface;

a plurality of second attenuators spaced laterally from one another and spaced laterally across the width of the second barrier layer, each of said second attenuators having a plurality of second support members connected to one another in a geometric pattern, each second support member having a first end connected to a first connector and a second end connected to a second connector, and wherein each second attenuator has a geometric shape with a plurality of sides formed by the second support members connected in the geometric pattern;

a second supporting cable extending laterally across the grade surface, wherein upper portions of the second barrier layer are attached to said second supporting cable, and each of said plurality of second attenuators are secured to said second supporting cable; and second anchor points for securing opposite lateral ends of said second supporting cable to the grade surface.

25. A system for mitigating rockfall events on a grade surface, the system comprising:

a barrier layer having a width extending laterally across the grade surface and a length extending substantially perpendicular to the grade surface;

a plurality of attenuators spaced laterally from one another and spaced laterally across the width of the barrier layer, each attenuator having a plurality of support members connected to one another in a geometric pattern, each support member having a first end connected to a first connector and a second end connected to a second connector, and wherein each attenuator has a geometric shape with a plurality of sides formed by the support members connected in the geometric pattern;

a supporting cable extending laterally across the grade surface, wherein an upper portion of the barrier layer is attached to said supporting cable, and each of said plurality of attenuators are secured to said supporting cable;

a first anchor point for securing a first end of said supporting cable; and a second anchor point for securing a second opposite end of said supporting cable.

26. A system, as claimed in claim 25, further including;

at least one braking elements connected to the barrier layer for dissipating energy form an impact against the barrier layer.

27. A system, as claimed in claim 25, further including;

at least one secondary anchor secured to said barrier layer to provide additional anchoring capability, said secondary anchor being spaced longitudinally from said barrier layer.

* * * * *